US006830104B2

(12) United States Patent
Nguyen et al.

(10) Patent No.: US 6,830,104 B2
(45) Date of Patent: Dec. 14, 2004

(54) WELL SHROUD AND SAND CONTROL SCREEN APPARATUS AND COMPLETION METHOD

(75) Inventors: Philip D. Nguyen, Duncan, OK (US); Michael W. Sanders, Duncan, OK (US); Ron Gibson, Duncan, OK (US); David Lord, Marlow, OK (US); David McMechan, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/929,255

(22) Filed: Aug. 14, 2001

(65) Prior Publication Data

US 2003/0034160 A1 Feb. 20, 2003

(51) Int. Cl.[7] ..... E21B 43/08

(52) U.S. Cl. ..... 166/278; 166/227; 166/231; 166/235; 166/236

(58) Field of Search ..... 166/278, 236, 166/233, 227, 51, 230, 2, 235

(56) References Cited

U.S. PATENT DOCUMENTS

| | | | | |
|---|---|---|---|---|
| 5,330,005 | A | 7/1994 | Card et al. | |
| 5,439,055 | A | 8/1995 | Card et al. | |
| 5,492,178 | A | 2/1996 | Nguyen et al. | |
| 5,501,274 | A | 3/1996 | Nguyen et al. | |
| 5,501,275 | A | 3/1996 | Card et al. | |
| 5,532,249 | A | 7/1996 | Wilkerson et al. | |
| 5,551,514 | A | 9/1996 | Nelson et al. | |
| 5,582,279 | A | 12/1996 | Buchanan, Jr. et al. | |
| 5,775,425 | A | 7/1998 | Weaver et al. | 166/276 |
| 5,783,527 | A | 7/1998 | Dobson, Jr. et al. | |
| 5,888,944 | A | 3/1999 | Patel | |
| 5,909,774 | A | 6/1999 | Griffith et al. | |
| 5,931,229 | A | 8/1999 | Lehr et al. | |
| 5,934,376 | A | 8/1999 | Nguyen et al. | 166/278 |
| 6,220,345 | B1 * | 4/2001 | Jones et al. | 166/51 |
| 6,263,972 | B1 | 7/2001 | Richard et al. | |
| 6,409,219 | B1 * | 6/2002 | Broome et al. | 285/3 |
| 6,427,775 | B1 * | 8/2002 | Dusterhoft et al. | 166/278 |
| 6,520,254 | B2 * | 2/2003 | Hurst et al. | 166/278 |

OTHER PUBLICATIONS

Brochure, "Sand Control Applications," by Halliburton Energy Services, Inc, undated.
Brochure, "STIMPAC Service Brochure," by Schlumberger Limited, undated.

(List continued on next page.)

*Primary Examiner*—David Bagnell
*Assistant Examiner*—Giovanna Collins
(74) *Attorney, Agent, or Firm*—Peter V. Schroeder

(57) ABSTRACT

Improved methods and apparatus for completing a subterranean zone penetrated by a wellbore are provided. The improved methods basically comprise the steps of placing a sand control screen (e.g., screens, screened pipes, perforated liners, prepacked screens, etc.) and an outer shroud assembly mounted over the sand screen in the wellbore adjacent the zone to be completed, the shroud having perforated and blank (non-perforated) segments with the blank segments corresponding to selected intervals of the wellbore, for example problem zones such as shale streaks or isolated zones where flows are restricted by mechanical seals or packers, and injecting particulate material into the wellbore, whereby gravel packing takes place in the remaining length of the wellbore/shroud annulus without voids. The inner annulus between the shroud and screen provides an alternate flow path for the slurry to bypass the blocked intervals and continue with its placement. Mechanical seals or packers may be used in combination with the shroud and associated sand screen. The method is also applicable to placing gravel packs in a cased and perforated well drilled in the zone.

54 Claims, 5 Drawing Sheets

OTHER PUBLICATIONS

M. Economides, L. Watters & S. Dunn–Norman, Petroleum Well Construction on 537–42, undated.
Dickinson, W. Et al: "A Second–Generation Horizontal Drilling System," Paper 14804 presented in 1986 IADC/SPE Drilling/Conference in Dallas, TX.
Dickinson, W. et al.: "Gravel Packing Of Horizontal Wells," Paper 16931 presented at 1987 SPE Annual Technical Conference and Exhibition held in Dallas, Texas, Sep. 27–39;.
M. Economides, L. Watters & S. Dunn–Norman, Petroleum Well Construction Section 18–9.3, at 533–34 (1998).
LaFontaine, L. et al.: "New Concentric Annular Packing System Limits Bridging in Horizontal Gravel Packs," Paper 56778 presented at the 1999 SPE Annual Technical Conference and Exhibition in Houston, Texas, Oct. 3–6.
PoroFlex Expandable Screen Completion Systems.
STIMPAC Service Brochure, "Legal Information" 2000 Schlumberger Ltd.
"Sand Control Application" by Halliburton Engineering Services, Inc.
Skin Factor, "Petroleum Well Consruction," Economides, et al., 1998, pp. 8–10; 405–409; 533–534; and 537–542.
W. Dickinson, et al., "A Second–Generaltion Horizontal Drilling System," paper 14804 presented at the 1987 IADC/SPE Drilling Conference, Dallas, Texas 2/10–13/86.

T. E. Becker, et al., Drill–In Fluid Filter–Cake Bahavior During the Gravel–Packing of Horizontal Intervals—A Laboratory Simulation, SPE paper 50715.

M.E. Brady, et al., "Filtercake Cleanup in Open–Hole Gravel–Packed Completions: A Necessity or A Myth?" SPE paper 63232.

B. Todd, "Laboratory Device for Testing of Delayed–Breaker Solutions on Horizontal Wellbore Filter Cakes", SPE paper 68968.

W. Dickinson, et al, "Gravel Packing of Horizontal Wells," paper 16931 presented at the 1987 SPE Annual Technical Conference and Exhibition, Dallas, Texas, 9/27–29/87.

J. LaFontaine, "New Concetric Annular Packing System Limits Bridging in Horizontal Gravel Packs," SPE paper 56778.

* cited by examiner

| TEST PARAMETERS | TEST 1 | TEST 2 | TEST 3 | TEST 4 | TEST 5 | TEST 6 |
|---|---|---|---|---|---|---|
| PUMP RATE (bbl/min) | 3.1 | 3.1 | 3.1 | 3.1 | 3.1 | 3.1 |
| WASHPIPE RETURN RATE (bbl/min) | 2.24 | 2.24 | 2.24 | 3.1 | 2.51 | 2.51 |
| TOTAL LEAKOFF RATE (bbl/min) | 0.86 | 0.86 | 0.86 | 0 | 0.59 | 0.59 |
| SAND CONC. (ppg) | 1 | 1 | 1 | 1 | 1 | 1 |
| ANNULAR VELOCITY (ft/sec) | 2 | 2 | 2 | 2 | 2 | 2 |
| CARRIER FLUID | 25 lb/Mgal HEC | 25 lb/Mgal HEC | 25 lb/Mgal HEC | WATER | WATER | WATER |
| COMMENT | ISOLATION RING WAS UNSTABLE, ALLOWED SAND SLURRY TO ENTER THE OUTER ANNULUS | SAND SLURRY WAS STILL ABLE TO ENTER THE OUTER ANNULUS | SCREENED OUT IN THE HOSE CONNECTING THE PUMP AND THE MODEL | PROBLEM CORRECTED | | |

TO FIG. 6B

*FIG. 6A*

FROM FIG. 6A

| LOCATION ALONG WELLBORE | PACKING EFFICIENCY (%) | | | | | |
|---|---|---|---|---|---|---|
| WINDOW 1 | 100 | 100 | 100 | 100 | 100 | 100 |
| WINDOW 2 | 100 | 100 | 100 | 100 | 100 | 100 |
| WINDOW 3 | 100 | 100 | 100 | 100 | 100 | 100 |
| WINDOW 4 | 100 | 100 | 100 | 100 | 100 | 100 |
| WINDOW 5 | 80-90 | 95 | 70-80 | 100 | 100 | 100 |
| WINDOW 6 | 80-90 | 95 | 70-80 | 100 | 100 | 100 |
| WINDOW 7 | 100 | 100 | 100 | 100 | 100 | 100 |
| WINDOW 8 | 99 | 100 | 99 | 100 | 100 | 100 |
| WINDOW 9 | 100 | 100 | 99 | 100 | 100 | 100 |
| WINDOW 10 | 100 | 85 | 70-80 | 100 | 100 | 100 |
| WINDOW 11 | 100 | 95 | 70-80 | 100 | 100 | 100 |
| WINDOW 12 | 100 | 100 | 100 | 100 | 100 | 100 |
| WINDOW 13 | 100 | 100 | 100 | 100 | 100 | 100 |
| WINDOW 14 | 100 | 100 | 100 | 100 | 100 | 100 |
| WINDOW 15 | 95 | 90 | 70 | 100 | 100 | 100 |
| WINDOW 16 | 95 | 95 | 70 | 100 | 100 | 100 |
| WINDOW 17 | 95 | 80 | 70 | 100 | 100 | 100 |
| WINDOW 18 | 100 | 100 | 100 | 100 | 100 | 100 |
| WINDOW 19 | 100 | 100 | 100 | 100 | 100 | 100 |
| WINDOW 20 | 100 | 100 | 100 | OMIT | OMIT | OMIT |

*FIG. 6B*

WELL SHROUD AND SAND CONTROL SCREEN APPARATUS AND COMPLETION METHOD

TECHNICAL FIELD

This invention relates to improved methods and apparatus for completing wells, and more particularly to improved methods and apparatus for gravel packing, fracturing or frac-packing wells to provide alternative flow paths and a means of bypass to bypass isolated or problem zones and to allow complete gravel placement in the remainder of the wellbore as well as in the bypass area.

BACKGROUND OF THE INVENTION

Long horizontal well completions have become more viable for producing hydrocarbons, especially in deepwater reservoirs. Gravel packing with screens has been used to provide sand control in horizontal completions. A successful, complete gravel pack in the wellbore annulus surrounding the screen, as well as in the perforation tunnels if applicable, can control production of formation sand and fines and prolong the productive life of the well.

Cased-hole gravel packing requires that the perforations or fractures extending past any near-wellbore damage as well as the annular area between the outside diameter (OD) of the screen and the inside diameter (ID) of the casing be tightly packed with gravel. See Brochure: "Sand Control Applications," by Halliburton Energy Services Inc., which is incorporated herein by reference for all purposes. The open-hole gravel-pack completion process requires only that the gravel be tightly packed in the annulus between the OD of the screen and the openhole.

Several techniques to improve external gravel-pack placement, either with or without fracture stimulation, have been devised. These improved techniques can be performed either with the gravel-pack screen and other downhole equipment in place or before the screen is placed across the perforations. The preferred packing methods are either 1) prepacking or 2) placing the external pack with screens in place, combined with some sort of stimulation (acid-prepack), or with fracturing or acidizing. The "acid-prepack" method is a combination stimulation and sand control procedure for external gravel-pack placement (packing the perforations with gravel). Alternating stages of acid and gravel slurry are pumped during the treatment. The perforations are cleaned and then "prepacked" with pack sand.

Combination methods combine technologies of both chemical consolidation and mechanical sand-control. Sand control by chemical consolidation involves the process of injecting chemicals into the naturally unconsolidated formation to provide grain-to-grain cementation. Sand control by resin-coated gravel involves placing a resin-coated gravel in the perforation tunnels. Resin-coated gravel is typically pumped as a gel/gravel slurry. Once the resin-coated gravel is in place, the resin sets up to form a consolidated gravel filter, thereby removing the need for a screen to hold the gravel in place. The proppant pumped in a frac treatment may be consolidated into a solid (but permeable) mass to prevent proppant-flow back without a mechanical screen and to prevent formation sand production. U.S. Pat. No. 5,775,425, which is incorporated herein by reference for all purposes, discloses an improved method for controlling fine particulates produced during a stimulation treatment, including the steps of providing a fluid suspension including a mixture of a particulate coated with a tackifying compound and pumping the suspension into a formation and depositing the mixture within the formation.

A combined fracturing and gravel-packing operation involves pumping gravel or proppant into the perforations at rates and pressures that exceed the parting pressure of the formation. The fracture provides stimulation and enhances the effectiveness of the gravel-pack operation in eliminating sand production. The fracturing operation produces some "restressing" of the formation, which tends to reduce sanding tendencies. See Brochure: "STIMPAC Service Brochure," by Schlumberger Limited, which is incorporated herein by reference for all purposes. The high pressures used during fracturing ensure leakoff into all perforations, including those not connected to the fracture, packing them thoroughly. Fracturing and gravel packing can be combined as a single operation while a screen is in the well.

"Fracpacking" (also referred to as "HPF," for high-permeability fracturing) uses the tip-screenout (TSO) design, which creates a wide, very high sand concentration propped fracture at the wellbore. See M. Economides, L. Watters & S. Dunn-Norman, *Petroleum Well Construction*, at 537–42 (1998), which is incorporated herein by reference for all purposes. The TSO occurs when sufficient proppant has concentrated at the leading edge of the fracture to prevent further fracture extension. Once fracture growth has been arrested (assuming the pump rate is larger than the rate of leakoff to the formation), continued pumping will inflate the fracture (increase fracture width). The result is short but exceptionally wide fractures. The fracpack can be performed either with a screen and gravel-pack packer in place or in open casing using a squeeze packer. Synthetic proppants are frequently used for fracpacks since they are more resistant to crushing and have higher permeability under high confining stress.

In a typical gravel pack completion, a screen is placed in the wellbore and positioned within the zone which is to be completed. The screen is typically connected to a tool which includes a production packer and a cross-over port, and the tool is in turn connected to a work string or production string. A particulate material which is usually graded sand, often referred to in the art as gravel, is pumped in a slurry down the work or production string and through the cross-over port whereby it flows into the annulus between the screen and the wellbore and into the perforations, if applicable. The liquid forming the slurry leaks off into the subterranean zone and/or through the screen which is sized to prevent the sand in the slurry from flowing therethrough. As a result, the sand is deposited in the annulus around the screen whereby it forms a gravel pack. The size of the sand in the gravel pack is selected such that it prevents formation fines and sand from flowing into the wellbore with produced fluids.

The "Alpha-Beta" gravel-pack technique has been used to place a gravel pack in a horizontal hole. See Dickinson, W. et al.: "A Second-Generation Horizontal Drilling System,"

paper 14804 presented at the 1986 IADC/SPE Drilling Conference held in Dallas, Tex., February 10–12; Dickinson, W. et al.: "Gravel Packing of Horizontal Wells," paper 16931 presented at the 1987 SPE Annual Technical Conference and Exhibition held in Dallas, Tex., September 27–39; and M. Economides, L. Watters & S. Dunn-Norman, *Petroleum Well Construction* Section 18–9.3, at 533–34 (1998), which are all incorporated herein by reference for all purposes.

The Alpha-Beta method primarily uses a brine carrier fluid that contains low concentrations of gravel. A relatively high flow rate is used to transport gravel through the workstring and cross-over tool. After exiting the cross-over tool, the brine-gravel slurry enters the relatively large wellbore/screen annulus, and the gravel settles on the bottom of the horizontal wellbore, forming a dune. As the height of the settled bed increases, the cross-sectional flow area is reduced, increasing the velocity across the top of the dune. The velocity continues to increase as the bed height grows until the minimum velocity needed to transport gravel across the top of the dune is attained. At this point, no additional gravel is deposited and the bed height is said to be at equilibrium. This equilibrium bed height will be maintained as long as slurry injection rate and slurry properties remain unchanged. Changes in surface injection rate, slurry concentration, brine density, or brine viscosity will establish a new equilibrium height. Incoming gravel is transported across the top of the equilbrium bed, eventually reaching the region of reduced velocity at the leading edge of the advancing dune. In this manner, the deposition process continues to form an equilibrium bed that advances as a wave front (Alpha wave) along the wellbore in the direction of the toe. When the Alpha wave reaches the end of the washpipe, it ceases to grow, and gravel being transported along the completion begins to back-fill the area above the equilibrium bed. As this process continues, a new wave front (Beta wave) returns to the heel of the completion. During deposition of the Beta wave, dehydration of the pack occurs mainly through fluid loss to the screen/washpipe annulus.

Successful application of the Alpha-Beta packing technique depends on a relatively constant wellbore diameter, flow rate, gravel concentration, fluid properties and low fluid-loss rates. Fluid loss can reduce local fluid velocity and increase gravel concentration. Both will increase the equilibrium height of the settled bed or dune. Additionally, fluid loss can occur to the formation and/or to the screen/washpipe annulus.

The key to successful frac packs and gravel packs is the quantity of gravel placed in the fracture, perforations and casing/screen annulus. The development of bridges in long perforated intervals or highly deviated wells can end the treatment prematurely, resulting in reduced production from unpacked perforations, voids in the annular gravel pack, and/or reduced fracture width and conductivity.

U.S. Pat. No. 5,934,376, which is incorporated herein by reference for all purposes, discloses a sand control method called CAPS™, for concentric annular packing system, developed by Halliburton Energy Services, Inc. See also Lafontaine, L. et al.: "New Concentric Annular Packing System Limits Bridging in Horizontal Gravel Packs," paper 56778 presented at the 1999 SPE Annual Technical Conference and Exhibition held in Houston, Tex., October 3–6, which is incorporated herein by reference for all purposes. CAPS™ basically comprises the steps of placing a slotted liner or perforated shroud with an internal sand screen disposed therein, in the zone to be completed, isolating the perforated shroud and the wellbore in the zone and injecting particulate material into the annuli between the sand screen and the perforated shroud and the wellbore to thereby form packs of particulate material therein. The system enables the fluid and sand to bypass any bridges that may form by providing multiple flow paths via the perforated shroud/screen annulus.

The CAPS™ assembly consists of a screen and washpipe, with the addition of an external perforated shroud. The CAPS™ concept provides a secondary flow path between the wellbore and the screen, which allows the gravel slurry to bypass problem areas such as bridges that may have formed as the result of excessive fluid loss or hole geometry changes.

Flow is split among the three annuli. A gravel slurry is transported in the outer two annuli (wellbore/shroud and shroud/screen), and filtered, sand-free fluid is transported in the inner annulus (screen basepipe/washpipe). If either the wellbore/shroud or shroud/screen annulus bridges off, the flow will be reapportioned among the annuli remaining open.

One problem area in horizontal gravel packs is the ability to bypass problems zones such as shale streaks. Horizontal completions often contain shale zones, which can be a source of fluid loss and/or enlarged hole diameters with subsequent potential problems during the gravel pack completion. In addition, shale zones may complicate selection of the appropriate wire-wrapped screen gauge. Another potential problem of shale zones is sloughing and hole collapse after the screen is placed. In open hole wellbores sloughing of shale or unstable formation materials can cause premature screen out during gravel pack treatment, leaving most of the well bore annulus unpacked or voided.

Completion of horizontal wells as open holes leaves operators with little or no opportunity to perform diagnostic or remedial work. Many horizontal wells that have been producing for several years are now experiencing production problems that can be attributed to the lack of completion control. The main reason for alternative well completions is that open holes do not allow flexibility for zonal isolation and future well management. The competence of the formation rock is a first consideration in deciding how to complete a horizontal well. In an unconsolidated formation, sand production often becomes a problem.

One completion design for horizontal wells includes the use of slotted or blank liner, or sand-control screen, separated by external-casing packers (ECP's). Generally, the packers are hydraulically set against the formation wall. However, gravel packing operations would be impossible because the ECP's become barriers, blocking the flow paths of gravel slurry. Gravel placement in the zones below the isolated zone is prevented.

Thus, there are needs for improved methods and apparatus for completing wells, especially in the case of open-hole well bores where sloughing problems may occur or to allow flexibility for zonal isolation and well management.

SUMMARY

The present invention provides improved methods and apparatus for completing wells which meet the needs described above and overcome the deficiencies of the prior art.

In accordance with an embodiment of the present invention, a method of well completion is provided in which a liner or shroud assembly with perforated and blank (i.e., non-perforated) segments in association with a sand control screen, is installed in combination with external-casing packers to provide alternate flow paths and a means for gravel placement for sand control. The shroud assembly is used to provide alternate flow paths for gravel slurry to bypass problem zones such as shale streaks or isolation zones where flows are restricted or prohibited by mechanical seals or packers.

The blank sections of the shroud that correspond with the isolated zones or locations where sloughing problems may potentially occur should remain blank. Alternatively, substantially blank sections may be used which contain a reduced number of perforations, or else perforations sized and located so that excessive fluid loss to the formation is avoided.

Using apparatus of the present invention with a nonperforated shroud segment bounded by isolating means such as external casing packers (ECPs), a means of bypass, such as a concentric bypass can be placed adjacent to a shale zone with perforated shroud segments (and wellbore/shroud and shroud/screen annuli) above and below.

The present methods can be combined with other techniques, such as prepacking, fracturing, chemical consolidation, etc. The methods may be applied at the time of completion or later in the well's life. The unconsolidated formation can be fractured prior to or during the injection of the particulate material into the unconsolidated producing zone, and the particulate material can be coated with curable resin and deposited in the fractures as well as in the annulus between the sand screen and the wellbore.

Other and further objects, features and advantages of the present invention will be readily apparent to those skilled in the art upon a reading of the description of preferred embodiments which follows when taken in conjunction with the accompanying drawings.

DESCRIPTION OF THE DRAWINGS

FIG. 6 is a table showing the results obtained for tests in a 300-ft. isolation model test apparatus used to demonstrate the effectiveness of packing the areas above and below an isolated section, simulating collapsed shale, in accordance with methods of the present invention.

DETAILED DESCRIPTION OF THE INVENTION

The present invention provides improved methods and apparatus for completing wells, including gravel packing, fracturing or frac-packing operations to bypass problem zones such as shale streaks or other zones that need to be isolated where flows are restricted or prohibited by mechanical seals or packers. The methods can be performed in either vertical, deviated or horizontal wellbores which are open-hole or, have casing cemented therein. If the method is to be carried out in a cased wellbore, the casing is perforated to provide fluid communication with the zone.

Since the present invention is applicable in horizontal and inclined wellbores, the terms "upper" and "lower" and "top" and "bottom," as used herein are relative terms and are intended to apply to the respective positions within a particular wellbore, while the term "levels" is meant to refer to respective spaced positions along the wellbore.

Figure 1:
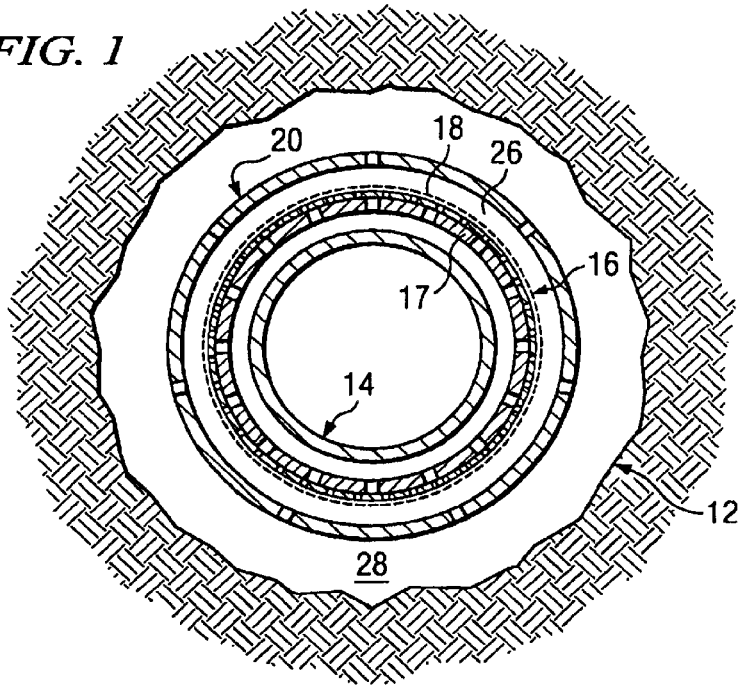
FIG. 1 is a cross-sectional view of apparatus embodying principles of the present invention comprising a sand control screen, washpipe and outer shroud assembly with perforated and blank segments (blank segments not shown in FIG. 1), in an open-hole wellbore at a production zone.

Referring to the drawings, FIG. 1 shows sand screen 16, washpipe 14 and outer shroud 20 installed in an open-hole wellbore 12 at a production zone 33 (shown in FIG. 3), whereby an annulus 26 is formed between the screen 16 and shroud 20. The outer shroud 20 is of a diameter such that when it is disposed within the wellbore 12 an annulus 28 is formed between it and the wellbore 12.

Sand screen 16 has a "crossover" sub (not shown) connected to its upper end, which is suspended from the surface on a tubing or work string (not shown). A packer (not shown) is attached to the crossover. The crossover and packer are conventional gravel pack forming tools and are well known to those skilled in the art. The packer is used to permit fluid/slurry to crossover from the workstring to the wellbore/screen annulus during packing. The crossover provides channels for the circulation of proppant slurry to the outside of the screen 16 and returns circulation of fluid through the screen 16 and up the washpipe 14. The washpipe 14 is attached to the gravel pack service tool and is run inside the screen 16. The washpipe 14 is used to force fluid to flow around the bottom of the screen 16.

Screen 16 is comprised of a perforated base pipe 17 having wire wrap 18 wound thereon.

The term "screen" is used generically herein and is meant to include and cover all types of similar structures which are commonly used in gravel pack well completions which permit flow of fluids through the "screen" while blocking the flow of particulates (e.g. other commercially-available screens; slotted or perforated liners or pipes; sintered-metal screens; mesh screens; screened pipes; pre-packed screens, radially-expandable screens and/or liners; or combinations thereof).

Screen 16 may be of a single length as shown in the drawings, or it may be comprised of a plurality of basically identical screen units which are connected together with threaded couplings or the like (not shown).

Figure 2:
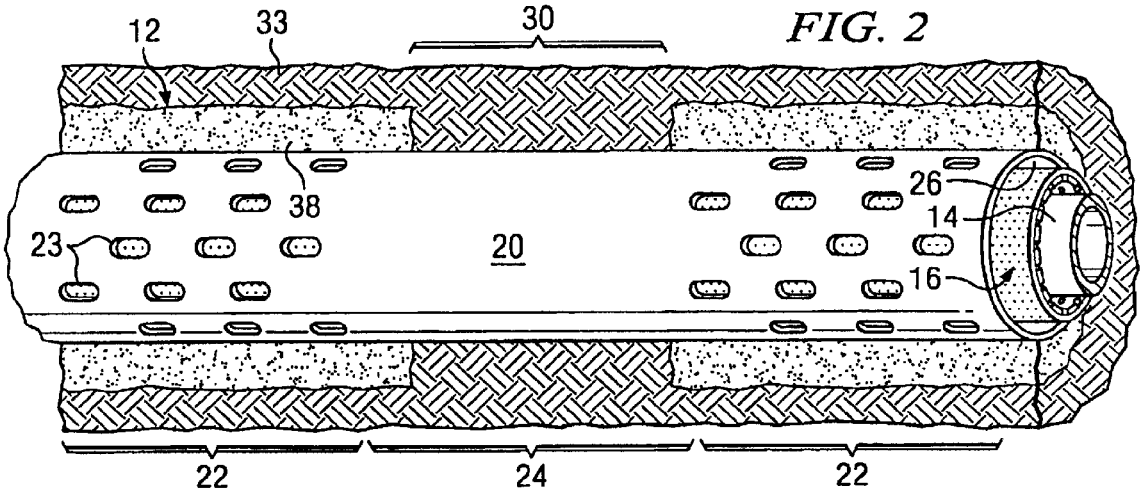
FIG. 2 is a schematic view of apparatus embodying principles of the present invention in an open-hole wellbore, and shows a blank segment of the shroud assembly allowing the flow of slurry to bypass an obstructed area caused by sloughing or unstable formation materials.

FIG. 2 shows outer shroud 20 with perforated and blank (non-perforated) segments 22 and 24 respectively, installed in wellbore 12 which has unstable or problem zone 30 where sloughing problems may occur (details of screen 16 not shown in FIG. 2).

Perforations or slots 23 in perforated segments 22 can be circular as illustrated in the drawings, or they can be rectangular, oval or other shapes. Generally, when circular slots are utilized they are at least ¼ in. in diameter, and when rectangular slots are utilized they are at least ¼ in. wide by ½ in. long.

In FIG. 2 outer shroud 20 is positioned in wellbore 12 so that blank segments 24 lie substantially adjacent to the unstable interval 30 in wellbore 12. The inner annulus 26 between shroud 20 and screen 16 provides an alternate flow path for the slurry to bypass the interval 30 and continue with its placement.

Figure 3:
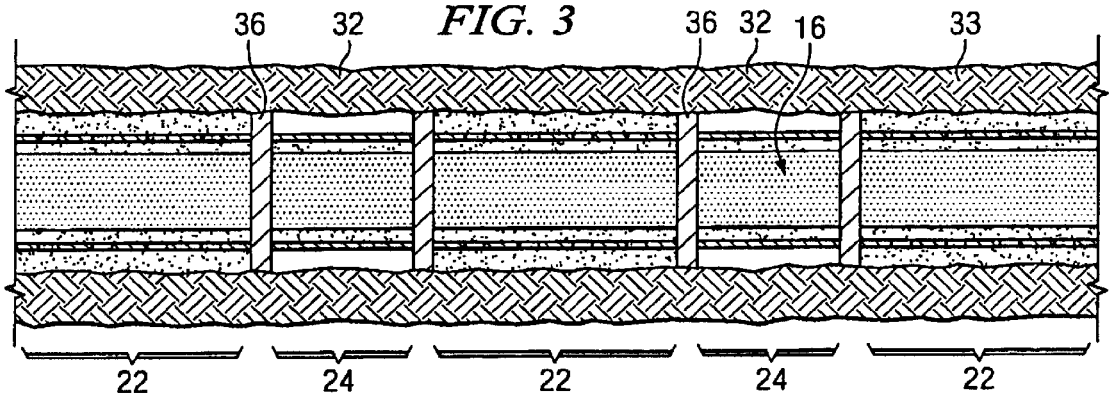
FIG. 3 is a schematic view depicting use of the shroud assembly with perforated and blank segments in gravel packing a long-interval, horizontal well with isolated zones.

FIG. 3 shows wellbore 12 with isolated zones 32 where flow is restricted or prohibited by isolating means such as mechanical seals or packers, such as external-casing packer, or isolating tool 36. In FIG. 3 outer shroud 20 is installed in combination with external-casing packers 36 to provide alternate flow paths and a means for gravel placement for sand control, bypassing the ECP's and their isolating intervals.

In operation, sand screen 16 and outer shroud 20 are assembled and lowered into wellbore 12 on a workstring (not shown) and positioned adjacent the zone which is to be completed. Gravel slurry is then pumped down the workstring, out through a crossover or the like and into the annulus 26 between sand screen 16 and shroud 20. Flow continues into the annulus 28 between shroud 20 and the wellbore 12 by way of perforations 23 in perforated segment 22 of shroud 20. If the wellbore/shroud annulus 28 bridges off, the flow will be reapportioned among the annuli remaining open. Blank segments 24 of shroud 20 correspond with the isolated zones 32 or unstable intervals 30 where sloughing problems may potentially occur, of wellbore 12. The inner annulus 26 between the shroud and screen provides an alternate path for the slurry to bypass the blocked intervals and continue with its placement.

Figure 4:
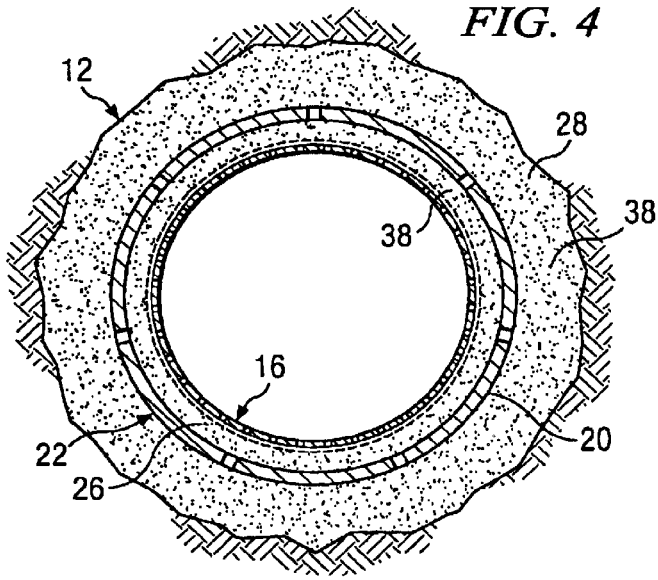
FIG. 4 is a cross-sectional view showing gravel packed in the wellbore/shroud and shroud/screen annuli at a production zone in accordance with methods of the present invention.

FIG. 4 shows gravel pack 38 in the wellbore/shroud and shroud/screen annuli 28 and 26, respectively, at a production zone in accordance with methods of the present invention. Annulus 28 is packed between the wellbore 12 and the perforated segment 22 of the shroud, and annulus 26 is packed between the segment 22 and the screen 16.

Figure 5:
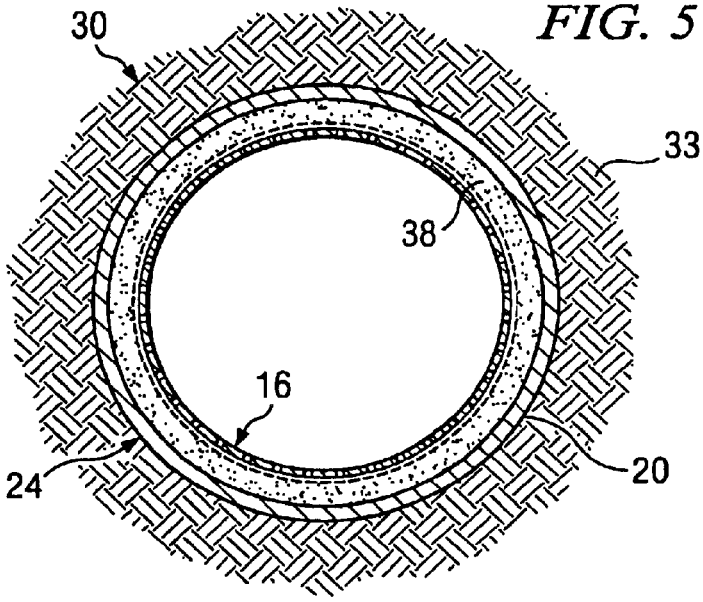
FIG. 5 is a cross-sectional view showing gravel packed in the annulus between a blank segment of the shroud assembly and a sand control screen at a collapsible or isolated zone in accordance with methods of the present invention.

FIG. 5 shows gravel pack 38 in the annulus between blank segment 24 of the shroud 20 and sand screen 16 at a collapsible zone 30 or isolated zone in accordance with methods of the present invention.

Conventional sand control screens or premium screens, such as POROPLUST™ screens sold by Purolator Facet, Inc., Greensboro, N.C., can be pre-installed inside the external shroud before being brought to the well site. The shroud provides protection to the screen during transport. The screens also can be lowered into the wellbore and inserted inside the shroud in the conventional manner. The shroud protects the screen from contacting the formation wall, minimizing it from damage or plugging.

Figure 7:
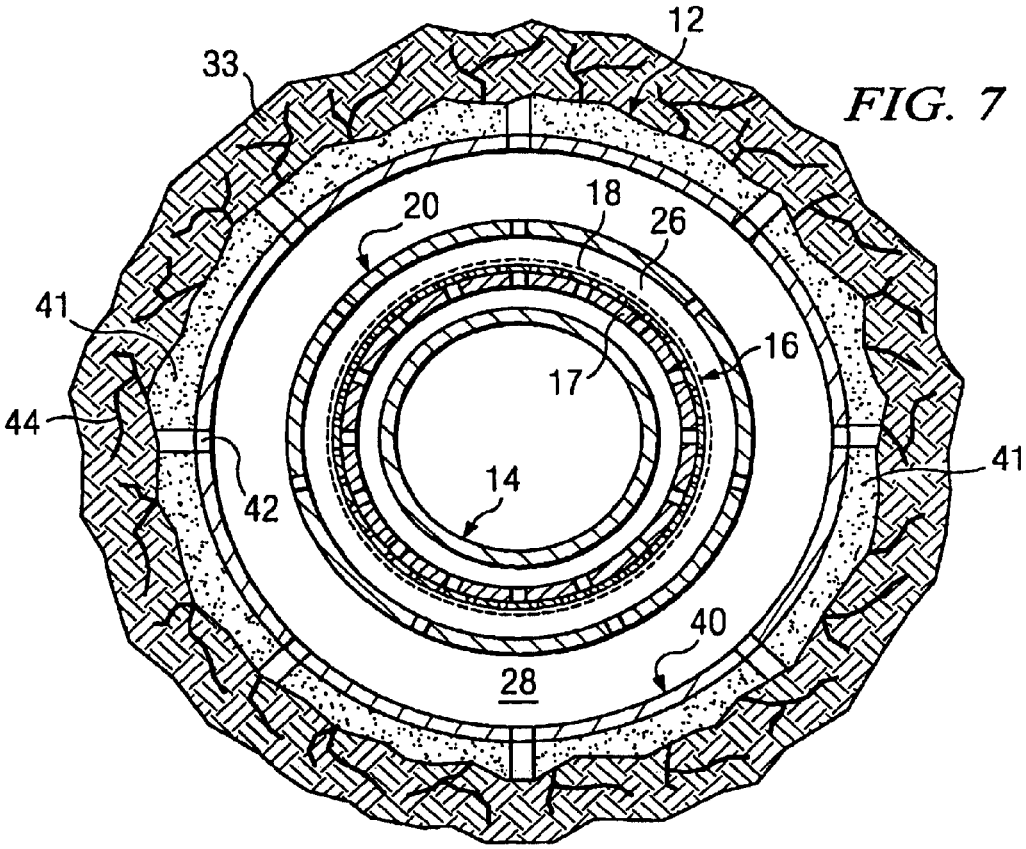
FIG. 7 is a cross-sectional view of an apparatus embodying the principles of the invention in a cased and cemented wellbore in a production zone.

The method of the present invention is also applicable to placing a gravel pack in a cased and perforated well drilled in an unconsolidated or poorly consolidated zone. FIG. 7 shows casing 40 and cement 41 with perforations 42. In this embodiment, the particulate material is caused to be uniformly packed in the perforations in the wellbore and within the annulus between the sand screen and the casing.

The creation of one or more fractures 44 in the unconsolidated subterranean zone 33 to be completed in order to stimulate the production of hydrocarbons therefrom is well known to those skilled in the art. The hydraulic fracturing process generally involves pumping a viscous liquid containing suspended particulate material into the formation or zone at a rate and pressure whereby fractures are created therein. The continued pumping of the fracturing fluid extends the fractures in the zone and carries the particulate material into the fractures. The fractures are prevented from closing by the presence of the particulate material therein.

The subterranean zone to be completed can be fractured prior to or during the injection of the particulate material into the zone, i.e., the pumping of the carrier liquid containing the particulate material through the perforated shroud into the zone. Upon the creation of one or more fractures, the particulate material can be pumped into the fractures as well as into the perforations and into the annuli between the sand screen and perforated shroud and between the perforated shroud and the wellbore.

To further illustrate the present invention and not by way of limitation, the following examples are provided.

Results from tests with a 40-ft. model with 10.6 in. OD and 8.6 in. ID have demonstrated that the shroud assembly with perforated and non-perforated segments, in combination with pack-off devices (to simulate the condition where flow through the annulus between the well bore wall and shroud is shut off, for segments of the shroud) allows gravel packing to take place in the remaining length of the model without voids. The "packed off" segment simulated the condition in which shale or unstable formation materials sloughed off and shut off the flow of gravel slurry in the outer annulus. The use of the shroud assembly allows the slurry to continue flowing inside the annulus between the shroud and the screen, permitting the well bore to be packed completely.

Six large scale tests using a 300 ft. steel model with acrylic windows were performed to demonstrate the effectiveness of the perforated and nonperforated shroud assembly in providing alternative flow paths and a concentric bypass to bypass a collapsed zone and to allow complete gravel placement in the remainder of the wellbore as well as in the concentric bypass area. The shroud assembly consisted of a liner with perforated and non-perforated segments that surrounds the screen and divides the screen-wellbore annular space into two separate, yet interconnected annuli.

During flow through the large cross-sectional areas of these annuli, the perforated holes in the liner provide multiple alternative flow paths allowing gravel slurry to find the path of least resistance when it encounters restrictions created by sand bridges, packed-off intervals, or formation abnormalities.

The simulated wellbore consisted of 6-inch ID, 20-ft. steel pipe segments joined together via metal clamps. With ½ inch thick wall, the model can handle high pumping pressure. Circular windows with 2-inch diameters were formed through a steel section. An acrylic sleeve was placed inside the steel section thus providing a window for observers to see the flow of sand inside the model. The 1-ft. window segments were placed at appropriate areas to aid in visualization of gravel placement progress.

The shroud assembly was prepared from 4-inch ID PVC pipe. The perforated segments had 36 holes per foot with hole size of 0.5 inch. Slotted (0.012 in. slots) PVC tubing with a 2.875 in. OD and a 2.50 in. ID was used to simulate a sand control screen. Slotted PVC tubing was run most of the length of the wellbore, except for the first 10 ft. simulating blank pipe. A washpipe with OD of 1.90 in., which was also made from PVC tubing, was inserted inside the slotted PVC tubing. The purpose of using PVC tubing or pipe was to aid in dismantling the model after each test. The clamps on the outer steel model were taken off to expose the three layers of PVC pipe. A saw was used to cut through the sand and PVC pipes. This allowed the observers to see the packing efficiency at each connection.

The model was set up such that the first 100-ft. section contained a normal perforated shroud assembly. The middle 100-ft. of the model was set up using blank shroud to form a concentric bypass to bypass the simulated shale zone. Isolation rings were placed on either side of the blank shroud to force the slurry to flow through the annulus formed by the slotted PVC tubing OD and the shroud ID through this zone. Two massive leakoff assemblies were installed upstream and downstream of the isolation section with windows upstream and downstream of the massive leakoff assemblies.

Viscosified carrier fluid (25 lb/1000 gal hydroxyethyl cellulose {HEC} gelling agent) or tap water was used to transport gravel into the model. A gravel sand concentration in the amount of 1 lbm/gal was pumped into the model with a design input rate of 3.1 BPM to achieve an effective 2.0 ft/sec flow velocity in the model.

The choice of hole size, hole pattern, and number of holes per foot in the perforated shroud should be matched to the carrier fluid being utilized in a particular completion design, and also to the annular velocity. They should be selected, not only based on the effectiveness of providing alternative flow paths for packing the wellbore annulus completely, but also based on the well production performance.

The results of the tests are set forth in FIG. 6. As gravel entered the model, the Alpha Wave progressed through the first 100-ft of the model (which had the perforated shroud assembly). The flow then channeled into the concentric blank shroud bypass within the isolation section of the second 100-ft via the perforated shroud and continued to the end of the model. The Beta Wave began at the last observation window and progressed back through the last 100-ft of the model. It then again channeled through the blank shroud bypass of the isolation section, and then back out of the first isolation ring via the perforated shroud, and proceeded to complete back packing of the first 100-ft.

Throughout the gravel placement, both massive leakoff assemblies were opened to allow each leakoff area to have a fluid loss rate ranging from 10 to 20% of the total pump rate.

It was observed that gravel was successfully placed in the desired locations, i.e., upstream and downstream of the isolation section, and in the concentric bypass through the isolation section. After unclamping the model and cutting through the gravel and PVC tubing, a good pack was observed upstream and downstream of the isolation section. A good pack was also noted in the annulus of the isolation section concentric bypass (i.e., between blank shroud ID and screen pipe OD).

Thus, the present invention is well adapted to carry out the objects and attain the ends and advantages mentioned as well as those which are inherent therein. While numerous changes may be made by those skilled in the art, such changes are included in the spirit of this invention as defined by the appended claims.

It is claimed:

1. Apparatus for completing a subterranean zone penetrated by a wellbore to provide a means of bypass to bypass a selected interval in said zone, said apparatus comprising:

a sand screen a shroud surrounding said sand screen creating an annulus therebetween, said shroud having a perforated section and at least one blank section with the at least one blank section corresponding to the selected interval to be bypassed, the perforated section providing fluid communication between the annulus and an area outside of the shroud for flow of particulate laden material.

2. The apparatus of claim 1 further comprising an isolating means in combination with the shroud and associated sand screen, the isolating means located along a blank section of the shroud.

3. The apparatus of claim 2 wherein said isolating means comprises an external-casing packer.

4. Apparatus for gravel packing a wellbore that penetrates a subterranean zone, and allowing a selected interval of said zone to be bypassed during the gravel packing, said apparatus comprising:

a sand screen; and a shroud surrounding said sand screen, said shroud having a perforated section for delivering gravel slurry to said wellbore and at least one blank section corresponding to the selected interval to be bypassed, whereby an annulus is formed between said sand screen and said shroud and an alternate path for the slurry to bypass the selected interval and continue with its placement is provided.

5. The apparatus of claim 4 further comprising means for sealing the annulus between the blank section of the shroud and the wellbore.

6. The apparatus of claim 4 wherein said sealing means comprises a packer.

7. The apparatus of claim 4 wherein said sealing means comprises a mechanical seal.

8. An improved method of completing a subterranean zone penetrated by a wellbore comprising the steps of:

(a) placing in the wellbore in the zone a liner having at least one perforated and at least one blank section, with the at least one blank section corresponding to a selected interval of the wellbore;

(b) placing a sand screen in said liner whereby a first annulus is formed between said sand screen and said liner and a second annulus is formed between said liner and said wellbore; and (c) injecting particulate material into said first annulus and into said second annulus by way of the perforations in said liner, whereby the particulate material is packed in said first annulus, and in said second annulus in the regions above and below the selected interval of the wellbore.

9. The method of claim 8 wherein said particulate material is sand.

10. The method of claim 8 wherein said particulate material is manmade proppant.

11. The method of claim 8 wherein said particulate material is hardenable resin composition coated.

12. The method of claim 8 wherein said wellbore in said subterranean zone is openhole.

13. The method of claim 8 wherein said wellbore in said subterranean zone has casing cemented therein with perforations formed through the casing and cement.

14. The method of claim 8 wherein said wellbore in said zone is horizontal.

15. The method of claim 8 which further comprises the step of creating at least one fracture in said subterranean zone.

16. The method of claim 8 which further comprises the step of isolating at least a portion of the second annulus between said liner and said wellbore in said selected interval.

17. The method of claim 8 wherein said second annulus between sand liner and said wellbore is isolated by at least one packer in said wellbore.

18. The method of claim 8 wherein the step of injecting particulate matter further comprises the step of flowing particulate matter into the second annulus from the first annulus through the perforations in the liner.

19. The method of claim 8 wherein the particulate matter is suspended in a slurry.

20. The method of claim 19 further comprising the step of dehydrating the slurry.

21. The method of claim 20 further comprising flowing fluid from the slurry through the sand screen and then uphole thereby dehydrating the slurry.

22. The method of claim 20 further comprising flowing fluid from the slurry into the subterranean zone and then uphole thereby dehydrating the slurry.

23. The method of claim 8 further comprising flowing hydrocarbon from the zone through the particulate material, through the perforations and through the sand screen.

24. The method of claim 8 further comprising the step of placing in the wellbore multiple liners corresponding to multiple subterranean zones to be bypassed.

25. An improved method of completing a subterranean zone penetrated by a wellbore, comprising the steps of:

(a) placing in the wellbore in the zone a liner with perforated and blank sections and having an internal screen disposed therein whereby a first annulus is formed between said screen and said liner and a second annulus is formed between said liner and said wellbore;

(b) pumping a slurry of particulate material into said first annulus and into said second annulus by way of the openings in said perforated liner, whereby the particulate material is packed in said first and second annuli in the intervals of the wellbore substantially corresponding to the perforated sections of the liner, and the migration of formation particulates into said wellbore from the zone is substantially prevented upon flowing of fluid from said subterranean zone; and (c) flowing fluids from the zone and into said wellbore.

26. The method of claim 25 wherein said particulate material is sand.

27. The method of claim 25 wherein said particulate material is manmade proppant.

28. The method of claim 25 wherein said particulate material is hardenable resin composition coated.

29. The method of claim 25 wherein said wellbore in said subterranean zone is openhole.

30. The method of claim 25 wherein said wellbore in said subterranean zone has casing cemented therein with perforations formed through the casing and cement.

31. The method of claim 25 wherein said wellbore in said zone is horizontal.

32. The method of claim 25 which further comprises the step of creating at least one fracture in said subterranean zone.

33. The method of claim 25 which further comprises the step of isolating at least a portion of the second annulus between said liner and said wellbore in said selected interval.

34. The method of claim 25 wherein said second annulus between said liner and said wellbore is isolated by setting at least one packer in said wellbore.

35. The method of claim 25 further comprising the step of casing the wellbore.

36. The method of claim 25 further comprising the step of dehydrating the slurry.

37. The method of claim 25 wherein the wellbore has collapsed in the second annulus, thereby hindering fluid flow along the second annulus.

38. The method of claim 25 wherein the step of pumping the slurry further comprises the step of providing the slurry to the first annulus from the second annulus.

39. The method of claim 25 wherein the step of pumping the slurry further comprises the step of providing the slurry to the second annulus from the first annulus.

40. The method of claim 25 further comprising placing multiple blank liner sections corresponding to multiple subterranean zones in the wellbore.

41. The method of claim 40 further comprising the step of isolating multiple portions of the second annulus along the blank sections of liner.

42. A method for gravel packing a well that penetrates a subterranean oil or gas reservoir and bypassing a selected interval of the well during the gravel packing, comprising:

(a) providing a wellbore in said reservoir;

(b) locating a screen inside the wellbore;

(c) mounting a liner with perforated and blank sections over the screen whereby a first annulus is formed between said screen and said liner and a second annulus is formed between said liner and said wellbore, and the blank section of the liner corresponds to the selected interval to be bypassed; and (d) injecting a fluid slurry containing gravel into said first annulus and into said second annulus whereby the fluid portion of the slurry is forced at least partially into said reservoir and the gravel portion of the slurry is deposited in said first and second annuli, except for bypassing said second annulus in the region of said selected interval of the wellbore.

43. The method of claim 42 wherein said wellbore is openhole.

44. The method of claim 42 wherein said wellbore has casing cemented therein with perforations formed through the casing and cement.

45. The method of claim 42 further comprising the step of isolating at least a portion of the second annulus in said selected interval.

46. The method of claim 45 wherein the step of isolating comprises setting at least one packer in said wellbore.

47. A method for gravel packing selected intervals of a well that penetrates a subterranean oil or gas reservoir, comprising:

(a) providing a wellbore in said reservoir;

(b) locating a screen inside the wellbore;

(c) mounting a liner with perforated and blank sections over the screen, whereby a first annulus is formed between said screen and said liner and a second annulus is formed between said liner and said wellbore, and the perforated section of the liner corresponds to the intervals to be gravel packed; and (d) injecting a fluid slurry containing gravel into said first and second annuli whereby the fluid portion of the slurry is forced at least partially into said reservoirs and the gravel portion of the slurry is deposited in said first annulus and in said second annulus in the selected intervals of the wellbore.

48. The method of claim 47 wherein said wellbore is openhole.

49. The method of claim 47 wherein said wellbore has casing cemented therein with perforations formed through the casing and cement.

50. The method of claim 47 further comprising the step of isolating at least a portion of the second annulus in said selected interval.

51. The method of claim 50 wherein the step of isolating comprises setting at least one packer in said wellbore.

52. A method for gravel packing selected intervals of a well that penetrates a subterranean oil or gas reservoir, comprising:

(a) providing a wellbore in said reservoir;

(b) locating a screen inside the wellbore;

(c) mounting a liner with perforated and blank sections over the screen, whereby a first annulus is formed between said screen and said liner and a second annulus is formed between said liner and said wellbore, and the perforated section of the liner substantially corresponds to the intervals to be gravel packed;

(d) injecting a fluid slurry containing gravel into said first and second annuli whereby the fluid portion of the slurry is forced at least partially out of said annuli into said reservoir, and the gravel portion of the slurry is deposited in said annuli; and (d) sizing the cross-sectional area of and spacing the perforations in the perforated section of the liner so that if a portion of said second annulus is isolated thereby blocking the flow of fluid slurry through the said second annulus, fluid slurry containing gravel will continue to flow through said first annulus and bypass the isolated portion of the second annulus.

53. The method of claim 8 wherein the selected interval of the second annulus contains a naturally-occurring blockage.

54. The method of claim 53 wherein the blockage is due to sloughing.

* * * * *